United States Patent [19]

Anson

[11] 4,133,526

[45] Jan. 9, 1979

[54] GAME OF SKILL

[76] Inventor: Arthur H. Anson, 3301 Congress St., Allentown, Pa. 18104

[21] Appl. No.: 830,419

[22] Filed: Sep. 6, 1977

[51] Int. Cl.[2] ..... A63B 67/10; A63B 69/40

[52] U.S. Cl. ..... 273/1 R; 273/95 A; 35/22 R; 46/DIG. 1; 46/43

[58] Field of Search ..... 273/1 R, 1 M, 161, 98, 273/95 A, 1 E, 95 R, 97 R, 97 A, 99, 95 C; 46/DIG. 1, 43; 35/22 R

[56] References Cited

U.S. PATENT DOCUMENTS

| | | | |
|---|---|---|---|
| 793,002 | 6/1905 | Martin | 273/98 |
| 1,977,115 | 10/1934 | Conwill | 273/1 R |
| 3,788,641 | 1/1974 | Lemelson | 273/1 R X |
| 3,797,832 | 3/1974 | Benwell | 273/161 |
| 3,951,405 | 4/1976 | Long | 273/1 R |

FOREIGN PATENT DOCUMENTS

| | | | |
|---|---|---|---|
| 839464 | 7/1949 | Fed. Rep. of Germany | 273/95 C |
| 14976 of | 1887 | United Kingdom | 273/98 |

*Primary Examiner*—George J. Marlo
*Attorney, Agent, or Firm*—William B. Noll

[57] ABSTRACT

A game of skill utilizing a circular object, such as a light weight ball, having stripes or portions of tape, the surface of which is characterized by a burr-like material, laminated to said object, and a plurality of spaced apart rings through which such object must be skillfully maneuvered. Said rings, approximately four in number, are aligned with one another and held in spaced relationship by means of a frame. The ring openings are partially lined with a burr-like material to which the burr-like material of said object adheres upon contact. To test one's skill, said object, suspended from a string, is lowered through such aligned rings in a way to avoid contact between said object and the ring through which said object passes.

8 Claims, 1 Drawing Figure

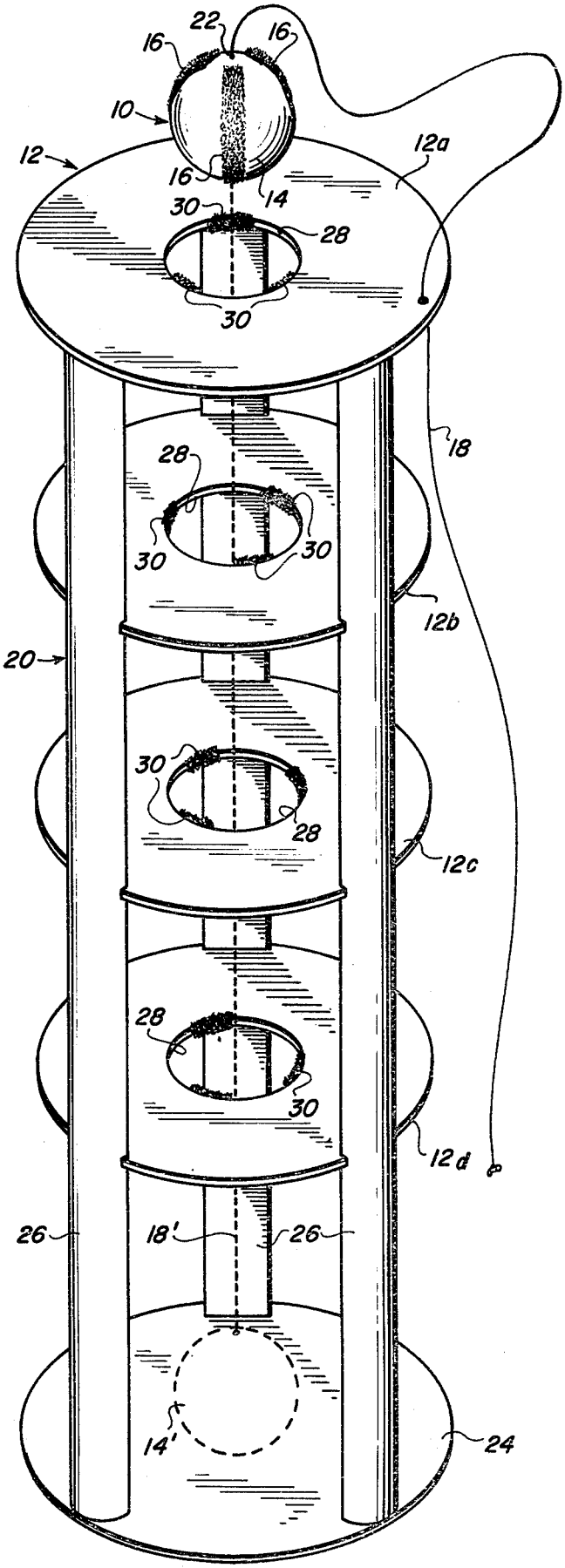
22
16
16
10
12
12a
16
14
30
28
30
18
28
30
30
12b
20
30
28
12c
28
30
12d
26
18'
26
14'
24

GAME OF SKILL

BACKGROUND OF THE INVENTION

This invention is directed to a game of skill for adults and children. More particularly, such invention is adapted to test the steadiness of one's hand as one attempts to maneuver the game's elements in the manner to be described hereinafter.

There are many games of skill that have been devised over the years to entertain and to challenge those who attempt to rise to the occasion. Some are directed to testing the mental skills while others are aimed at testing one's physical skills. The present invention falls within the latter category. Another game within such category is the tethered-ball game described by Walker, Jr. in U.S. Pat. No. 3,936,051. In such a game one or more players, by the manipulative action of the player's hips, attempt to place a tethered-ball into a circular receiving member. Success in such a game requires a large degree of mobility on the part of the players. As a consequence, such a game is restricted to large areas or the outdoors. Contrary to such space requirement, the skill game according to the present invention may be practiced while seated. In fact, minimum mobility and a steady hand are essential for success. This will become apparent in the specification to follow, particularly as the interaction of the several elements of this invention are described.

SUMMARY OF THE INVENTION

This invention is directed to a game of skill to test the steadiness of the hand of the player to be challenged. Such game of skill, in its preferred form, utilizes a lightweight ball having portions of its exterior surface provided with a burr-like material laminated to the ball. Cooperating with said ball in the operation of said game are a plurality of spaced apart rings through which such ball must be skillfully maneuvered. Said rings, preferably four in number, are aligned with one another and held in spaced relationship by means of a frame. The ring openings are partially lined with a burr-like material to which the burr-like material of said ball adheres upon contact. To test the player's skill, said ball, suspended from a line, is lowered through such aligned rings in a way to avoid contact between said ball and the ring through which it passes. The test is successful when the player maneuvers the ball down and back through each of the aligned rings.

BRIEF DESCRIPTION OF DRAWING

The FIGURE is a perspective view of the game of skill according to this invention, set up for the start of said game being shown in solid lines while a mid-game position is shown in phantom lines.

DETAILED DESCRIPTION OF PREFERRED EMBODIMENT

The present invention relates to a game of skill in which a player, testing the steadiness of his hand, manuevers an object through a series of aligned and spaced apart rings. Success is achieved by preventing contact between such object and such rings. The manner by which such player succeeds, or is caught short of his goal, is described in the following specification.

The major elements of this game of skill are the suspended object 10 and the parallel, aligned rings 12 shown in the FIGURE.

In a preferred form illustrated in the drawings, the suspended object 10 consists of a thin-walled, lightweight ball 14 formed of a thermoplastic such as polyethylene or the like. Though not limiting in dimensional size, a typical ball is approximately 43 cm. in diameter. On the exterior surface of the ball 14 are stripes 16 of a burr-like material. There is a large body of patent literature describing burr-like material and adhesives for attaching such material to various surfaces.

A convenient form of burr-like material for the stripes 16 is pressure sensitive synthetic tape material sold under the trademark "VELCRO". The tape has a textile backing coated with a pressure sensitive adhesive and an outer face or pile of closely spaced stiff plastic spines terminating in hook ends. The outer or hook surface adheres readily upon contact with many knit or tufted textiles and also with special "VELCRO" material having a surface or pile consisting of closely spaced plastic loops. This will be discussed in detail later.

The ball 14 is connected to a suspension line 18 which for convenience may be tethered to one of the rings 12 or frame 20. From a location 22 near the connection of said suspension line 18 to ball 14 a plurality of said stripes 16 of burr-like material are provided on the exterior surface of said ball 14. The stripes, preferably three in number, traverse the ball's exterior surface forming equally spaced arcs covering at least 90° thereabout. The number and maximum length of such stripes 16 are optional, provided that at the widest dimension of said ball 14, measured from location 22, there are alternate exterior surface portions of burr-like material interposed with exterior surface portions free of such burr-like material.

Interacting with ball 14 in a manner to be described hereinafter are a plurality of rings 12. Such rings 12, preferably about four in number, are essentially identical in size and are held in spaced relationship by means of frame 20. Frame 20 includes a base 24 and a plurality of vertical supports 26.

Each ring 12 is characterized by a central opening 28 shaped to the relative size of object 10. However, dimensionally such opening is slightly larger in order to permit passage of such object 10 through the opening. For an object, i.e. ball of 43 cm. in diameter, an opening 28 of about 51 cm. is recommended. Such difference of about 8 cm. allows for the slight projection of the burr-like material 16 from the exterior surface of the ball 14 while still assuring such ball's unrestricted passage through the openings 28.

The central openings 24 of rings 12, formed of plastic, wood or the like, are provided with discrete segments 30 of a burr-like material to which the burr-like material on the ball 14 adheres upon contact. By way of example, such discrete segments 30 may be constructed of a "VELCRO" material consisting of an exposed surface of closely spaced plastic loops. Such loops coact with the "VELCRO" hooks on ball 14.

In a given ring, the discrete segments 30, the number of which are equal to the strips 16 on ball 14, are uniformly spaced about the opening 28 as shown in the FIGURE. In a game structure according to this invention where three strips 16, and three discrete segments 30 per ring are used, the angular displacement of each discrete segment about a given ring will be about 120° from one another.

In a manner to raise the level of skill needed to succeed at the game of this invention, it is contemplated that adjacent rings 12, for example, rings **12*a* to 12*d*** will be angularly shifted with respect to the ring adjacent thereto. This may be illustrated in the following manner:

Based upon the angular position about the axis through the center of the openings 28, (1) ring 12*a* has discrete segments at about 0°, 120° and 240°, (2) ring 12*b* has discrete segments at about 30°, 150° and 270°, (3) ring 12*c* has discrete segments at about 60°, 180° and 300°, and (4) ring 12*d* has discrete segments at about 90°, 210° and 330°.

It will be understood that the number of rings, discrete segments of burr-like material for each ring, and angular position of such segments about the opening of each ring may vary from that illustrated in the drawings without departing from the spirit and scope of this invention. Finally, it is contemplated herein that provision may be made for turning the inner rings to effect a change in the relative position of such discrete segments on one ring to those on another. This may be accomplished by providing slots in vertical frame supports 26 in which rings 12*b* to 12*d* may slide or rotate.

The game according to this invention is played by maneuvering the suspended ball 14 through the rings 12*a*–12*d* and back. Such procedure is best accomplished by standing directly over the aligned rings 12*a*–12*d*, holding the suspension line and ball 14 at full length, and lowering such ball through the first ring 12*a*. To successfully maneuver such ball through such rings the laminated stripes of burr-like material on the ball's exterior surface must not touch the discrete segments of burr-like material about the ring openings. Since such discrete segments 30 of adjacent rings, for example 12*a* and 12*b*, may be angularly displaced from one another, the player while lowering the ball must twist the suspension line causing the ball to turn. When the ball has been shifted and realigned over ring 12*b*, the ball may be passed through such ring 12*b*. This procedure is continued until each ring has been successfully passed, by the ball, down to the phantom position (ball 14′ and suspension line 18′ ) above base 24 and lifted back.

It should be understood that object 10 may be an article other than a light-weight ball. However, light weight of the nature associated with a thin-walled thermoplastic ball is preferred as more skill is needed to maneuver such object through the rings. Nevertheless, the object 10 may consist of a golf, tennis or other types of common balls. Finally, such object 10 may take a shape other than a ball. Said object could be a "shot" glass, for example, provided such object is circular and does not exceed the diameter of the ring openings.

Thus, it is apparent that changes and modifications may be made in the embodiment of the invention as shown without departing from the spirit or scope of the present invention as defined by the appended claims.

I claim:

1. A game of skill in which a suspended object is gravity fed through a plurality of aligned and spaced apart rings, comprising:

(a) a circular object secured to a suspension line, an exterior surface on said object partially coated with a burr-like material, (b) a plurality of aligned rings, in which each ring is provided with a circular opening larger than the circumference of said object, where each opening is partially lined with a burr-like material to which the burr-like material of said object adheres upon contact, and (c) a frame maintaining said rings in an aligned and spaced relationship to one another.

2. The game of skill according to claim 1 wherein the burr-like material on the exterior surface of said object comprises a plurality of angularly disposed stripes from a position near the secured point of said suspension line to said object to a position at the widest circular dimension of said object.

3. The game of skill according to claim 2 wherein said object is a ball having three stripes uniformly spaced about said ball.

4. The game of skill according to claim 1 wherein there are a plurality of discrete segments of burr-like material lining the openings of each said ring.

5. The game of skill according to claim 4 wherein said discrete segments of a given ring are equally spaced about the said opening thereof.

6. The game of skill according to claim 4 wherein each said ring is provided with the same number of discrete segments of burr-like material equally spaced about the openings thereof.

7. The game of skill according to claim 6 wherein said discrete segments of a given ring are angularly displaced from the said discrete segments of an adjacent ring.

8. The game of skill according to claim 7 wherein said object is tethered to one of said rings.

* * * * *